United States Patent [19]

Watkin

[11] 4,335,476

[45] Jun. 22, 1982

[54] MATTRESS

[76] Inventor: Bernard C. Watkin, 32 W. Square, London SE 11, England

[21] Appl. No.: 127,806

[22] Filed: Mar. 6, 1980

[30] Foreign Application Priority Data

Mar. 8, 1979 [GB] United Kingdom ..... 7908244

[51] Int. Cl.[3] ..... A47C 27/14; A61G 7/00

[52] U.S. Cl. ..... 5/464; 5/461; 5/481

[58] Field of Search ..... 5/446, 447, 464, 481, 5/448, 461

[56] References Cited

U.S. PATENT DOCUMENTS 3,828,378 8/1974 Flam ..... 5/464
4,053,957 10/1977 Regan ..... 5/447
4,070,719 1/1978 Morgan ..... 5/481
4,147,825 4/1979 Talay ..... 5/481
4,161,045 7/1979 Regan ..... 5/464

*Primary Examiner*—Alexander Grosz
*Attorney, Agent, or Firm*—Wolf, Greenfield & Sacks

[57] ABSTRACT

A mattress for supporting the human body has shoulder-supporting and hip-supporting portions of less hardness than waist-supporting and foot-supporting portions. The hardnesses of the shoulder-supporting and hip-supporting portions are inter-related to the maximum hardness of the waist-supporting portions so that the mattress biases the spine of the user into a shape consisting of two concave curves separated by a convex curve, which gives a more comfortable mattress and has medical and orthopaedic advantages. The mattress can be used domestically, for specialist orthopaedic purposes and for general medical purposes.

9 Claims, 5 Drawing Figures

MATTRESS

This invention relates to mattresses.

To improve the comfort of a sprung mattress, it has been proposed to provide the mattress with softer portions for supporting the shoulders and hips of an adult human body lying on the mattress. The softer portions are obtained by the use of metal springs which are more compressible than the springs used in other portions of the mattress. Similarly British patent specification No. 1 445 561 discloses a mattress having softer portions for supporting the shoulders and hips and the portion which supports the shoulders is softer than the portion which supports the hips. The mattress is made from an apertured plastics foam and the softer portions are obtained by increasing the frequency and/or cross-sectional area of the apertures. However the modest improvement in comfort provided by such sprung or foam mattresses has not justified the extra complexity of the mattress.

An object of this invention is to improve still further the comfort of a mattress having softer portions for supporting the shoulders and hips.

I have found that to achieve a very comfortable mattress, it is not sufficient merely to provide softer portions for the shoulders and hips. The mattress must bias the spine of the lying body (whether it be lying on its back or side) to a very particular shape in which a majority of the thoracic vertebrae define a curve belonging to a particular family of concave curves, the lumbar vertebrae and possibly a few of the lower thoracic vertebrae define a curve belonging to a particular family of convex curves and the sacrum and coccyx define a curve belonging to a second particular family of concave curves and the curvature of the curves defined by the lumbar vertebrae and by the sacrum and coccyx should be greater than that of the curve defined by the thoracic vertebrae. Ideally all three curves should lie in the same plane and comfort increases as this ideal is approached.

In the mattress of this invention the resiliences of the portions of the mattress which support the shoulders, waist, hips and feet and the inter-relation between them are such as to support the body so that the spine is biassed to the correct position. The resiliences are defined in this specification in terms of the indentation hardness of the various portions of the mattress. "Indentation hardness" is measured according to British Standard 4443: Part 2: 1972 except that the indentor used has a diameter of 15.24 cms (i.e. 6 inches) and indentation is to a depth of 6.1 cms (i.e. 2.4 inches) and for the purposes of this specification, "indentation hardness" is defined accordingly. When "indentation hardness" is quoted hereinafter for a particular point on the surface of the mattress, the indentation hardness quoted is the indentation hardness measured when the centre of the indenting surface of the indentor coincides with that particular point.

This invention provides a mattress large enough to comprise a body-supporting surface of length 1.6 to 2.2 m having portions for supporting the waist, shoulders, hips and feet of the human body wherein the portions extend transversely of the longitudinal axis of the body-supporting surface and their indentation hardnesses to a depth of 6.1 cms are characterised as follows:

(a) in the waist-supporting portion (i) the maximum indentation hardness on the longitudinal axis of the body-supporting surface (hereinafter called Wam) is from 100 to 250 (preferably 180 to 250 and especially 200 to 230) N and (ii) the indentation hardness along said axis does not fall below 96 (preferably 99) % of Wam for a distance extending at least 5 (preferably 5 to 30) cms (b) in the shoulder-supporting portion (i) the minimum indentation hardness on said axis (hereinafter called Sam) is from 91 to 97 (preferably 92 to 95) % of Wam, (ii) the indentation hardness along said axis does not exceed 103% of Sam for a distance extending for from 15 to 40 cms and (iii) said distance of 15 to 40 cms commences at a point from 8 to 23 (preferably 10 to 18) cms from the nearest point on said axis at which the indentation hardness of the waist-supporting portion is Wam, (c) in the hip-supporting portion (i) the minimum indentation hardness on said axis (hereinafter called Ham) is from 87 to 95 (preferably 88 to 93) % of Wam subject to the limitation that Ham is less than Sam (ii) the indentation along said axis does not exceed 102% of Ham for a distance extending for from 7 to 35 cms and (iii) said distance of 7 to 35 cms commences at a point from 12 to 32 (preferably 20 to 26) cms from the nearest point on said axis at which the indentation hardness of the waist supporting surface is Wam and (d) in the foot-supporting portion the indentation hardness is 95 to 150 (preferably 100 to 210) % of Wam at a point on said axis which is 90 cms from the nearest point on said axis where the indentation hardness in the waist-supporting portion is Wam.

The "longitudinal axis" of the body-supporting surface is the axis which lies in the direction of the length of 1.6 to 2.2 m and which bisects the body-supporting surface. The inter-relation between the indentation hardnesses of the various portions of the mattress biasses the spine of a body lying on the mattress with its shoulders, waist, hips and feet supported by the appropriate portions into the particular shape needed for improved comfort. The indentation of the head-supporting portion is less critical and because this portion is usually covered by one or more pillows. Even so, it is preferred that the indentation hardness of the head-supporting portion be 75 to 150 (preferably 90 to 120) % of Wam because even when a pillow is used, the more the indentation hardness of the head-supporting portion falls below Wam, the further the upper part of the spine is biassed from the ideal state in which the thoracic concave curve lies in the same plane as the other curves whereupon neck and shoulder ache can occur. This is especially serious when the body is lying on its side. Preferably, the head-supporting portion should extend along the longitudinal axis for at least 12 cms.

Similarly, problems could occur with the foot-supporting portion because the more its indentation hardness falls below 95% of Wam (especially if it falls below Ham) the more the lower curves of the spine are biassed from the ideal state.

Preferably, the body-supporting surface extends transversely of the longitudinal axis to a distance of at least 0.25 m either side of the axis and preferably the indentation hardnesses along lines parallel to said axis are about the same as they are on said axis. In practice, this means that the body-supporting surface preferably has a minimum breadth of 0.5 m in which the indentation hardness stays about the same across the breadth though minor fluctuations will occur in the vicinity of springs or apertures.

The indentation hardness of a particular portion of the mattress may increase in regions preferably more than 0.25 from the longitudinal axis so as to bias a supported part of the body towards a particular (preferably central) region of the mattress. For example, shoulder- or hip-supporting portions may be circular or elliptical in horizontal section and have indentation hardnesses which decrease in the region of the circumference of the portion so as to bias the shoulder or hip towards the central region of the portions which support them.

Pairs of mattresses may be coupled side-by-side to make a double mattress or they may be made integrally to constitute a double mattress. The indentation hardnesses of the portions of a double mattress may be selected so as to be particularly suited to the male body in one half of the mattress and to the female body in the other half of the mattress. Luxury mattresses may have body-supporting surfaces extending beyond a length of 2.2 m, however the depressibility of such optional extra surfaces which extend beyond the surface required to support the sleeping body is not critical provided the surfaces are not too hard. Preferably, such extra surfaces have an indentation hardness of from 95 to 150% of Wam.

Preferably the mattresses have a thickness of from 10 to 23 (especially 13 to 17) cm.

The mattress may comprise any suitably resilient structure capable of providing the selected variations in indentation hardness. For example, the mattress may comprise metal (steel) springs or synthetic (preferably plastics) foams of differing indendation hardnesses. Variation of the hardness of plastics foam (preferably a closed-cell foam) may be achieved in several ways. For example, the foam may be apertured as described in British patent specification No. 1 445 561 and a greater number and/or size of hole is employed where lower indentation hardness is required. Alternatively, indentation hardness may be varied by varying the bulk density of the foam and/or by making different sections of the mattress from foams of plastics materials of different flexibilities. In particular, a compound mattress can be made which comprises a base layer of a more rigid plastics foam contoured to affect the hardness of the mattress at particular depths (especially at a depth of 6.1 cm) of of the mattress. The upper surface of the base layer may be overlaid with one or more layers of a softer plastics foam which increase depth and/or fills in the contours so as to provide a flat horizontal body-supporting surface.

The foams used in the construction of the mattresses may comprise any suitably resilient synthetic material and examples of suitably resilient plastics foams are discussed in the book "Plastic Foams" edited by K. C. Frisch and J. H. Saunders and published in 1972 by Marcel Dekker of New York. In particular, the synthetic material may be a polyurethane or an optionally cross-linked low, intermediate or high-density polyethylene or copolymer of ethylene with vinyl acetate or a polypropylene or a plasticised polyvinyl chloride. Polypropylenes of low metl flow index can be used to make hard foams whereas softer foams can be made using low density polyethylenes or plasticised polyvinyl chlorides.

If the mattress comprises an enclosing covering (for example the assembly of springs or the plastics foam may be enclosed in a close-fitting textile sleeve), the covering will probably affect the indentation hardness of the assembly of springs or plastics foam and so indentation hardness mattresses comprising close-fitting enclosing covers should be determined on a mattress which is ready for use with its cover in place. Preferably the cover should consist of a knitted cloth or of a cloth woven from crimped fibres because such cloths are easily stretched. It is especially preferred that the cloth should be chosen so that the cover affects the indentation hardnesses to a depth of 6.1 cms of the assembly of springs or plastics foam by less than 0.05 N. It is also preferred that the chosen cloth be highly permeable to air so as not to impede ventilation of the mattress. For example a preferred suitable cloth would not prevent the passage of a stream of exhaled cigarette smoke.

Preferred embodiments of the invention will now be described with reference to the drawings of which:

Figure 1:
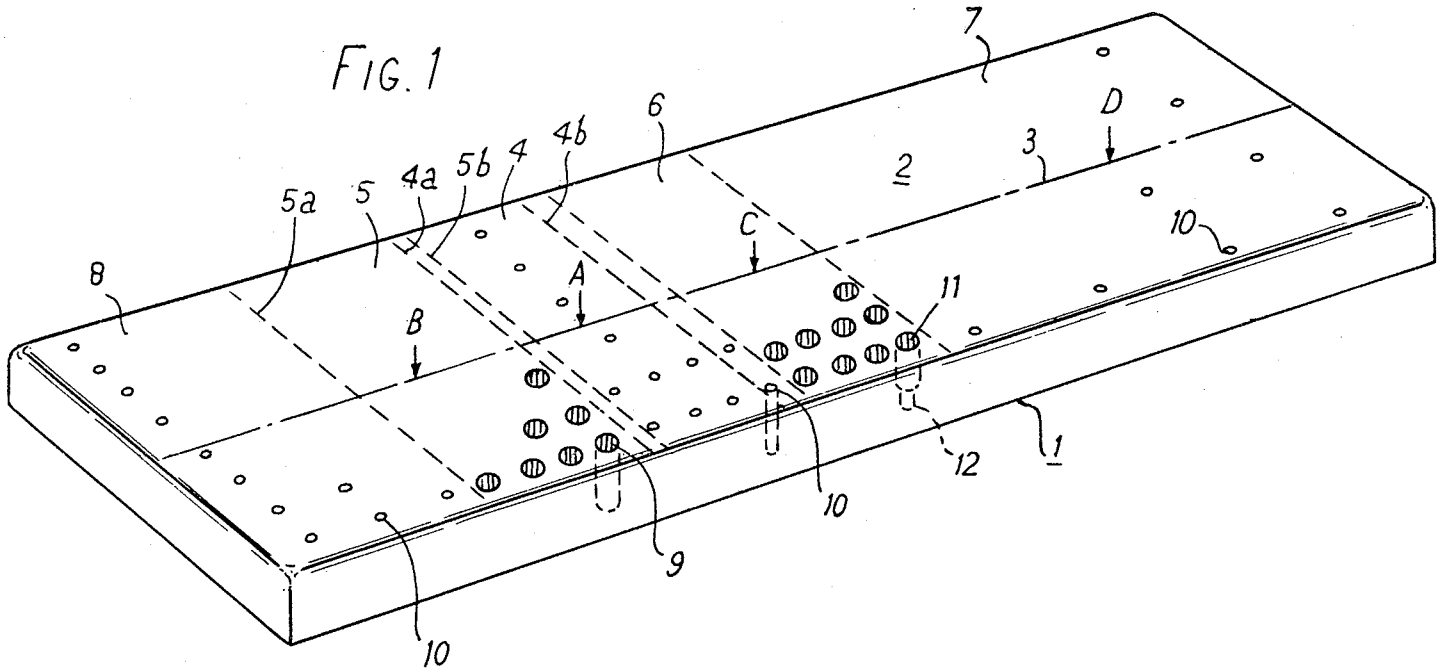
FIG. 1 is a perspective view of a mattress according to this invention.

FIG. 1 shows an uncovered apertured mattress 1 made from a closed cell polyurethane foam. Mattress 1 has a body-supporting surface 2 which is 2 m long and which has a longitudinal axis 3 whose position is shown by a dashed line. The longitudinal axis bisects body-supporting surface 2. Mattress 1 is 15.25 cms (i.e. 6 inches) thick and comprises waist-supporting portion 4, shoulder-supporting portion 5, hip-supporting portion 6, foot-supporting portion 7 and head-supporting portion 8 all of which portions extend a distance of 45 cms transversely of both sides of axis 3 to give a breadth of 90 cms.

Figure 2:
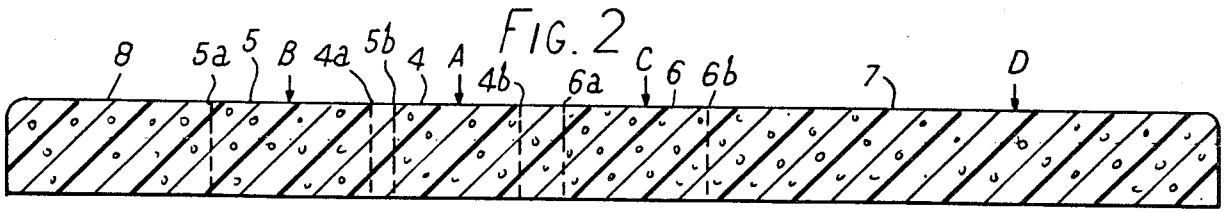
FIG. 2 is a section on the longitudinal axis shown in FIG. 1.
Figure 3:
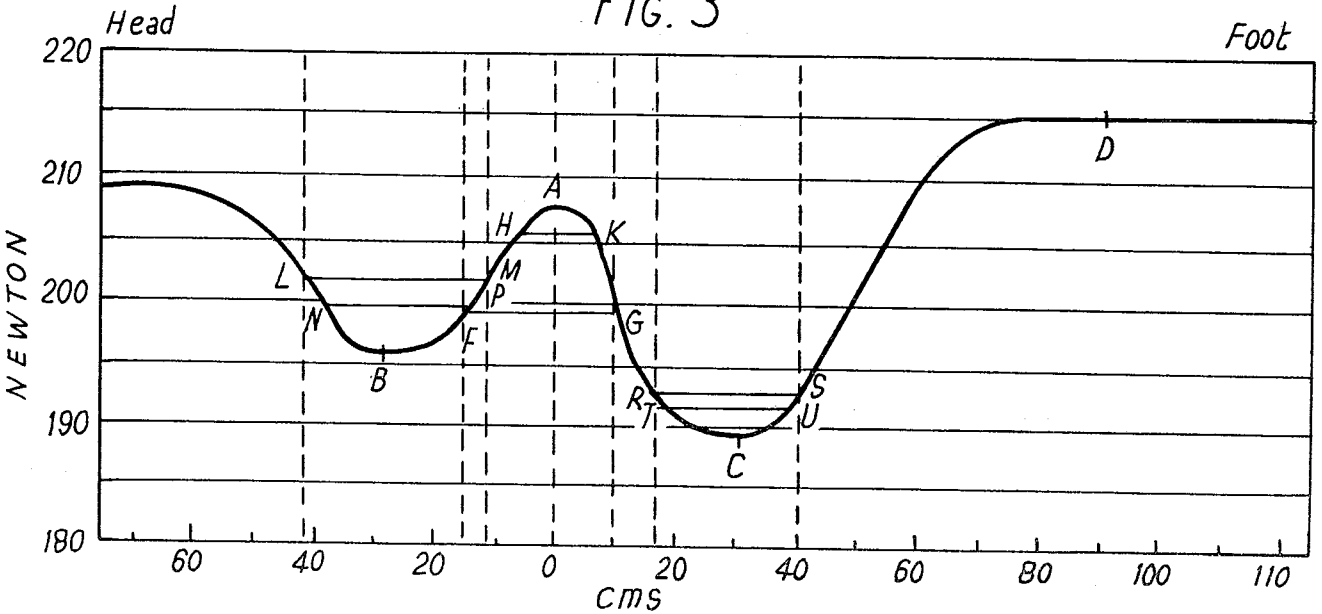
FIG. 3 is a diagram showing the indentation hardness at various points along the section shown in FIG. 2.

The maximum indentation hardness (Wam) on axis 3 in waist-supporting portion 4 is 207.5 N and it occurs at point A shown in FIG. 3 and indicated on FIGS. 1 and 2 by an arrow. The indentation hardnesses along axis 3 do not fall below 199.2 N (i.e. 96% of Wam) for a distance of 25 cms extending between dashed lines 4*a* and 4*b* which accordingly define the transverse boundaries of waist-supporting portion 4. This distance of 25 cms is represented by line FG in FIG. 3. The indentation hardnesses along axis 3 also do not fall below 205.5 N (99% of Wam) for a distance extending 12 cms represented by line HK in FIG. 3.

The minimum indentation hardness (Sam) on axis 3 in Shoulder-supporting portion 5 is 196 N (i.e. 94.5% of Wam) and occurs at point B also indicated by an arrow in FIGS. 1 and 2. The indentation hardnesses along axis 3 do not exceed 201 N (i.e. 102% of Sam) for a distance of 30 cms extending between dashed lines 5*a* and 5*b* and represented by line LM in FIG. 3. Dashed lines 5*a* and 5*b* accordingly define the transverse boundaries of shoulder-supporting portion 5 and it will be seen that waist-supporting portion 4 and shoulder-supporting portion 5 coincide between dashed lines 4*a* and 5*b* where the indentation hardness of mattress 1 satisfies the critieria for both portions 4 and 5. The distance of 30 cms represented by line LM commences at line 5b which is 11 cms from point A. The minimum indentation hardness of shoulder-supporting portion 5 also does not exceed 101% of Sam for a distance of 25 cms represented by line NP in FIG. 3. The minimum indentation hardness (Ham) on axis 3 in hip-supporting portion 6 is 189 N (i.e. 91% of Wam) and occurs at point C also indicated by arrows in FIGS. 1 and 2. The indentation hardnesses along axis 3 do not exceed 192.5 N (i.e. 102% of Ham) for a distance of 23 cms extending between dashed lines 6a and 6b and represented by line RS in FIG. 3. Dashed lines 6a and 6b accordingly define the transverse boundaries of hip-supporting portion 6. The distance of 23 cms represented by line RS commences at line 6a which is 17 cms from point A. The minimum indentation hardness along axis 3 of hip-supporting portion 5 also does not exceed 191 N (i.e. 101% of Ham) for a distance of 18 cms represented by line TU in FIG. 3.

The indentation hardness of foot-supporting portion 7 on axis 3 at a point D (indicated by arrows in FIGS. 1 and 2) which is 90 cms from point A. The indentation hardness of head-supporting portion 8 on axis 3 at a point 70 cms from point A is 209 N.

The variation in indentation hardness in mattress 1 is obtained by means of apertures 9, 10 and 11 (not all shown) which are distributed at various frequencies over body-supporting surface 2. Apertures 9 have a wide diameter whereas aperatures 10 have a narrow diameter. Apertures 11 have a wide diameter leading into a section 12 of narrower diameter to create a dash-pot effect. Apertures 9, 10, 11 also serve to ventilate body-supporting surface 2. The diameter of the apertures is preferably from ½ to ¾ inch.

Apertures 9, 10 and 11 occur with a constant frequency across any particular breadth of mattress 1 so that the indentation hardness and ventilation of mattress 1 is substantially constant across any particular breadth.

Figure 4:
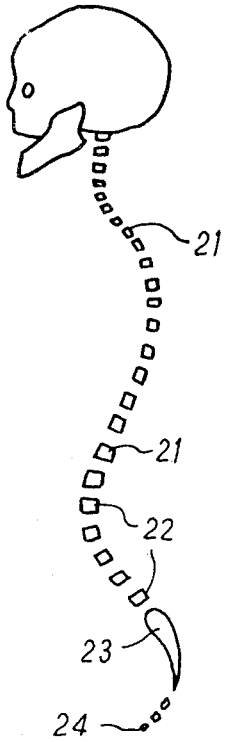
FIG. 4 is a side elevation of a spine which indicates the combination of convex and concave curves required for improved comfort.

Irrespective of whether a body lies on its back or side, the various indentation hardnesses of mattress 1 bias the spine into a shape of the kind shown in FIG. 4 and in which the two concave curves and the convex curve are substantially coplanar (provided that the shoulders, waist, hips and feet of the body are supported by the appropriate portions of mattress 1). FIG. 4 shows that the top ten thoracic vertebrae 21 define a concave curve, the lumbar vertebrae 22 and lower two thoracic vertebrae define a convex curve of greater curvature than that defined by the other thoracic vertebrae 21, and the sacrum 23 and coccyx 24 define a concave curve of greater curvature than that defined by the top thoracic vertebrae 21. Accordingly mattress 1 is very comfortable irrespective of whether the body lies on its back or on its side.

Figure 5:
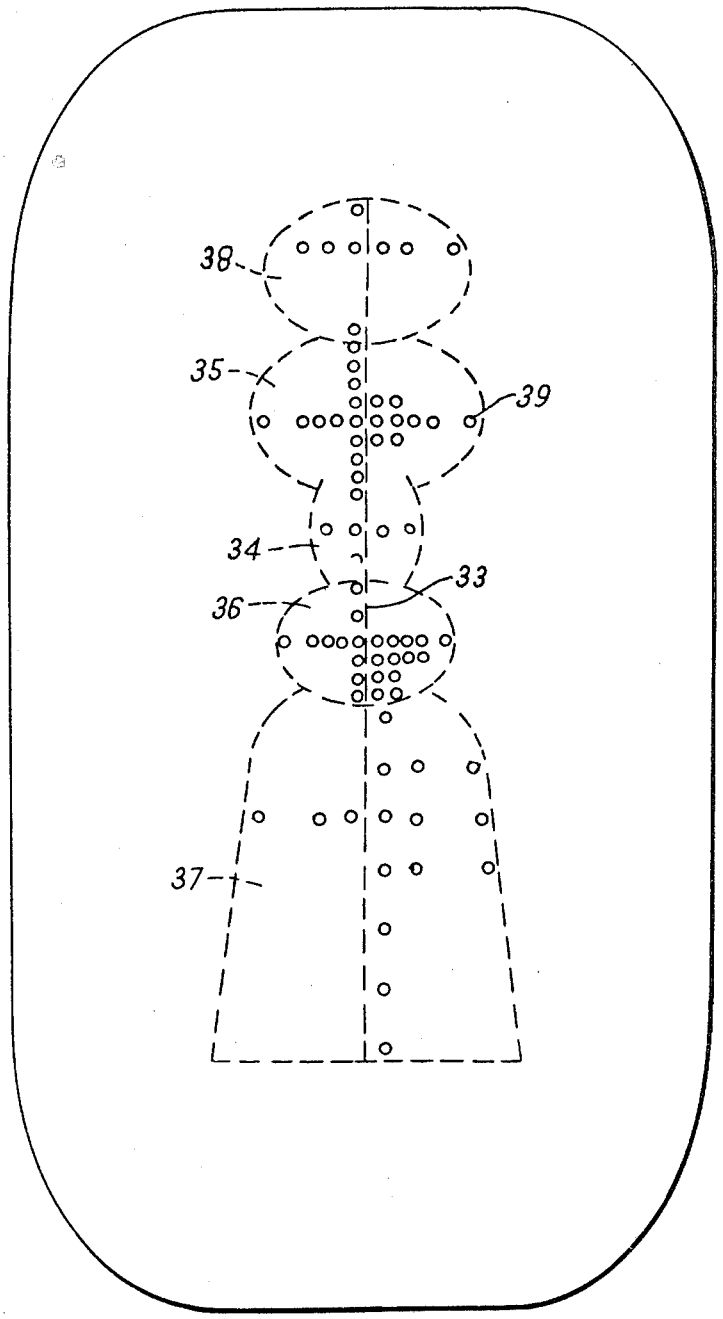
FIG. 5 is a plan view of a luxury mattress.

FIG. 5 shows a luxury mattress 31 having a body-supporting surface comprising portions 34, 35, 36, 37 and 38 for supporting a waist, shoulders, hips, feet and head. The body supporting surface has a longitudinal axis 33 which is 2.2 m long. Mattress 1 extends beyond its body-supporting surface. The indentation hardness of the mattress is varied by means of apertures 39 which occur with greater frequency in the softer portions of mattress 1. The frequency of apertures 39 decreases in the peripheral regions of the body-supporting surface so as to increase the hardness of these regions and bias a body towards axis 33.

The mattresses of this invention may be used domestically, for specialist orthopaedic purposes or for general medical purposes for which it exhibits three additional advantages. Firstly, it produces a more even distribution of pressure on a patient's body and therefore can often be more effective than a ripple bed in reducing the incidence of bed sores. Secondly, the biassing of the spine into the preferred shape means that the patient's body is less cramped which can be of help in treating certain conditions (e.g. respiratory diseases). Holding the spine in the correct position also minimises the pressure on organs such as the heart, lungs and liver of the user.

Thirdly, if the head- and shoulder-supporting portions are raised so as to support the patient in a sitting position, it has been found that the hip-supporting portion engages the patient's bottom efficiently enough to resist the tendency for the patient to slide down the bed. The mattress may be formed in two parts, hinged together about a transverse line in the upper surface of the mattress, so that the head and shoulder-supporting portions of the mattress can be raised to support the user in a sitting position. The hinge is positioned in the region of the junction of the waist- and hip-supporting portions of the mattress, so that in the sitting position the hip-supporting portion engages the user's buttocks and prevents the user from sliding down the bed. To allow the mattress to hinge, the fabric covering may be divided along the sides and underside of the mattress, suitable fastening means, such as tapes, being provided to connect the adjoining edges of the cover when the mattress is laid flat.

The improved distribution of pressure on the skin of the user, referred to above, is particularly useful in reducing bed sores on the heels, buttocks and sacrum where they most commonly occur. The improved pressure distribution on the backs of the calves of a patient also helps to reduce the danger of thrombosis, which can occur when pressure is applied to the calves for long periods.

The provision of apertures in the apertured mattress allows the mattress to be used in combination with means for providing forced ventilation and/or temperature control using blown air.

I claim:

1. A mattress large enough to comprise a body-supporting surface of length 1.6 to 2.2 m having portions for supporting the waist, shoulders, hips and feet of the human body wherein the portions extend transversely of the longitudinal axis of the body-supporting surface and their indentation hardnesses to a depth of 6.1 cms are characterized as follows:

(a) in the waist-supporting portion
  (i) the maximum indentation hardness on the longitudinal axis of the body-supporting surface (hereinafter called Wam) is from 100 to 250 N and
  (ii) the indentation hardness along said axis does not fall below 96% of Wam for a distance extending at least 5 cms (b) in the shoulder-supporting portion
  (i) the minimum indentation hardness on said axis (hereinafter called Sam) is from 91 to 97% of Wam,
  (ii) the indentation hardness along said axis does not exceed 103% of Sam for a distance extending for from 15 to 40 cms and (iii) said distance of 15 to 40 cms commences at a point from 8 to 23 cms from the nearest point on said axis at which the indentation hardness of the waist-supporting portion is Wam, (c) in the hip-supporting portion (i) the minimum indentation hardness on said axis (hereinafter called Ham) is from 87 to 95% of Wam subject to the limitation that Ham is less than Sam (ii) the indentation along said axis does not exceed 102% of Wam for a distance extending for from 7 to 35 cms and (iii) said distance of 7 to 35 cms commences at a point from 12 to 32 cms from the nearest point on said axis at which the indentation hardness of the waist supporting surface is Wam and (d) in the foot-supporting portion the indentation hardess is 95 to 150% of Wam at a point on said axis which is 90 cms from the nearest point on said axis where the indentation hardness in the waist-supporting portion is Wam, whereby the interrelationship between the resiliencies of the said portions are such as to support the body of a user lying on the mattress so that the user's spine is biased to an optimum shape in which the majority of the thoracic vertebrae define a concave curve, the lumbar vertebrae define a convex curve and the sacrum and coccyx define a concave curve, the curves defined by the lumbar vertebrae and by the sacrum and coccyx being of greater curvature than the curve defined by the thoracic vertebrae.

2. A mattress as claimed in claim 1, in which:

(a) in the waist-supporting portion.

(i) the maximum indentation hardness on said axis (Wam) is from 180 to 250 N and (ii) the indentation hardness along said axis does not fall below 99% of Wam for a distance extending 5 to 30 cm;

(b) in the shoulder-supporting portion the minimum indentation hardness on said axis (Sam) is from 91 to 97% of Wam, (c) in the hip-supporting portion (i) the minimum indentation hardness on said axis (Ham) is from 88 to 93% of Wam;

(d) in the foot-supporting portion the indentation hardness is 100 to 210% of Wam at the said point.

3. A mattress as claimed in claim 2, in which:

(a) in the waist-supporting portion the maximum indentation hardness on said axis (Wam) is from 200 to 230 N (b) in the shoulder-supporting portion, said distance of 15 to 40 cm commences at a point from 10 to 18 cm from the nearest point on said axis at which the indentation hardness of the waist-supporting portion is Wam, and (c) in the hip-supporting portion, said distance of 7 to 35 cm commences at a point from 20 to 26 cm from the nearest point on said axis at which the indentation hardness of the waist-supporting surface is Wam.

4. A mattress as claimed in claim 1, in which the indentation hardness of the head-supporting portion is 75 to 150% of Wam.

5. A mattress as claimed in claim 4, in which the indentation hardness of the head-supporting portion is 90 to 120% of Wam.

6. A mattress as claimed in claim 1, in which the indentation hardness of the body supporting surface along lines parallel to said axis are substantially the same as those on said axis for distances of at least 0.25 m on each side of the axis.

7. A mattress as claimed in claim 6, in which the hardness of selected portions of the mattress increases at distances greater than the said 0.25 m so as to bias a supported part of the body towards the central regions of the selected portions of the mattress.

8. A mattress as claimed in claim 1, in which the mattress is formed of resilient plastics foam and the hardnesses of the said portions of the mattress are modified by means of holes formed in the mattress.

9. A mattress as claimed in claim 8, in which there is provided a covering of stretchable material which affects the indentation hardness of the plastics foam by less than 0.05 N.

* * * * *